US005820998A

United States Patent [19]

Hotaling et al.

[11] Patent Number: 5,820,998

[45] Date of Patent: Oct. 13, 1998

[54] COATED PAPER AND PROCESS FOR MAKING THE SAME

[75] Inventors: Raymond Dwayne Hotaling, Copake, N.Y.; Vladimir Hampl, Jr., Roswell, Ga.

[73] Assignee: Schweitzer-Mauduit International, Inc., Alpharetta, Ga.

[21] Appl. No.: 207,336

[22] Filed: Mar. 8, 1994

[51] Int. Cl.[6] ..... B32B 9/02; B32B 9/06; B32B 29/02; B32B 29/06

[52] U.S. Cl. ..... 428/533; 427/301; 427/324; 427/326; 427/333; 427/337; 427/338; 427/394; 427/395; 427/411; 427/414; 536/3; 162/135; 162/136; 162/137; 162/139; 131/365; 428/537.5

[58] Field of Search ..... 428/330, 532, 428/533, 537.5; 536/3; 131/360, 365, 137, 139; 162/135, 136, 139; 427/301, 337, 333, 338, 339, 340, 341, 384, 391, 387.9, 411, 342, 324, 394, 395, 414

[56] References Cited

U.S. PATENT DOCUMENTS

| | | | |
|---|---|---|---|
| 2,776,912 | 1/1957 | Gregory | 117/62 |
| 3,215,579 | 11/1965 | Hagen | 156/289 |
| 3,620,801 | 11/1971 | O'Grady | 117/36.4 |
| 3,949,762 | 4/1976 | West et al. | 131/2 |
| 4,077,414 | 3/1978 | Baker et al. | 131/8 R |
| 4,222,740 | 9/1980 | Bohm et al. | 8/448 |
| 4,267,240 | 5/1981 | Jaisle et al. | 428/484 |
| 4,622,983 | 11/1986 | Mathews et al. | 131/365 |
| 4,739,775 | 4/1988 | Hampl, Jr. | 131/365 |
| 4,805,644 | 2/1989 | Hampl, Jr. et al. | 131/365 |
| 4,984,589 | 1/1991 | Riedesser | 131/365 |
| 5,057,606 | 10/1991 | Garbe | 536/54 |
| 5,092,353 | 3/1992 | Montoya et al. | 131/360 |
| 5,131,416 | 7/1992 | Gentry | 131/365 |
| 5,178,167 | 1/1993 | Riggs et al. | 131/359 |
| 5,271,419 | 12/1993 | Arzonico et al. | 131/365 |

FOREIGN PATENT DOCUMENTS

| | | |
|---|---|---|
| 0375844A2 | 7/1990 | European Pat. Off. . |
| 0419975A2 | 4/1991 | European Pat. Off. . |
| 848332 | 9/1960 | United Kingdom . |

OTHER PUBLICATIONS

Martin Glicksman, *Food Hydrocolloids*, vol. II, 1983, pp.116, 117, 141–145, 158, 159, 174, 175.

Kelco/AIL International, Technical Bulletin P5056, Copyright© 1985.

Kelco—Division of Merck & Co., Inc., Third Edition, pp. 1–41, Apr. 1987.

European Search Report for EP Application No. 95101301.0, Mar. 12, 1996.

James P. Casey, Pulp and Paper Chemistry and Chemical Technology, pp. 1517–1521 and 1702–1703, Canada 1981.

Abstract, Patent Application No. 91–372448, Japan, Nov. 1991.

Abstract, Patent Application No. 86–004454, Japan, Nov. 18, 1985.

*Primary Examiner*—Vivian Chen

*Attorney, Agent, or Firm*—Dority & Manning, P.A.

[57] ABSTRACT

A process of making a coated paper comprises the following steps: 1) providing a paper layer composed of a blend of pulp fibers and particulate material containing polyvalent metal cations, 2) applying a acidified alginate solution of a material selected from salts and derivatives of alginic acid to cover at least a portion of the paper, 3) reacting the salts and/or derivatives of alginic acid with polyvalent metal cations in the paper to form a polymer coating, and 4) drying the paper and polymer coating. The permeability of the coated paper is generally at least about 75 percent less than the permeability of an identical uncoated portion of the paper. The solution of alginate material may be partially cross-linked. The alginate solution may be deposited utilizing gravure printing techniques. Also disclosed is a coated paper and a wrapper for a smoking article.

14 Claims, 1 Drawing Sheet

COATED PAPER AND PROCESS FOR MAKING THE SAME

FIELD OF THE INVENTION

The present invention relates to coated papers. More particularly, the present invention relates to wrapping papers used in smoking articles.

BACKGROUND OF THE INVENTION

In the past, papers have been treated to reduce their permeability. Such treated papers may be used to reduce the burn rate of cigarettes. Low permeability cigarette wrappers are desirable because they may reduce the ability of a burning cigarette to ignite a combustible material and may actually cause a cigarette to self-extinguish after burning undisturbed for a certain period of time.

Papers have been coated with water-soluble film-forming materials such as chemically modified cellulose, starches, guar gums, alginate, dextrin and gelatins. The effectiveness of these coatings at reducing permeability has typically depended on the amount of material applied. Generally speaking, more applied material results in lower permeability.

It is desirable to reduce the amount of water-soluble film-forming material applied to papers used in applications such as, for example, cigarette wrappers. Large amounts of coating materials which may be needed to provide reduced levels of permeability may produce papers having unacceptable flavor, appearance and/or performance when used in smoking articles. Excessive amounts of coating material may flake, peel or become detached from the paper and may add to the complexity of high speed paper manufacturing processes. Coating materials also add to the cost of manufacturing the coated paper. Reducing the amount of material applied to the paper may reduce the cost of the paper. Thus, a need exists for a practical process for making a coated paper having desirable reductions in permeability. There is also a need for a practical process for making a coated paper which uses relatively low levels of water-soluble, film-forming materials and which is suitable for high speed manufacturing processes. Meeting this need is important since it is operationally and economically desirable to have a process of coating papers which uses relatively low levels of water-soluble, film-forming materials, especially when the process is intended for the high speed manufacturing of coated papers.

There is also a need for a coated paper which does not employ large amounts of coating materials to achieve desired levels of permeability and in which the coating does not flake, peel or become detached from the paper. A need also exists for a wrapper for a smoking article which provides the desired levels of permeability and which does not produce unacceptable flavor, appearance and/or performance of the smoking article.

DEFINITIONS

The term "pulp" as used herein refers to cellulosic fibrous material from natural sources such as woody and non-woody plants. Woody plants include, for example, deciduous and coniferous trees. Non-woody plants include, for example, cotton, flax, esparto grass, milkweed, straw, jute, hemp, and bagasse. Pulp may be modified by various treatments such as, for example, thermal, chemical and/or mechanical treatments.

The term "salts and derivatives of alginic acid" as used herein refers to salts and/or derivatives of an acidic polysaccharide or gum which occurs as the insoluble mixed calcium, sodium, potassium and magnesium salt in the Phaeophyceae, brown seaweeds. Generally speaking, these are calcium, sodium, potassium and/or magnesium salts of high molecular weight polysaccharides composed of varying proportions of D-mannuronic acid and L-guluronic acid. Exemplary salts and/or derivatives of alginic acid include ammonium alginate, potassium alginate, sodium alginate, propylene glycol alginate and/or mixtures of the same.

The term "solution" as used herein refers to any relatively uniformly dispersed mixture of one or more substances (e.g., solute) in one or more other substances (e.g., solvent). Generally speaking, the solvent may be a liquid such as, for example, water and/or mixtures of liquids. The solvent may contain additives such as suspension agents, viscosity modifiers and the like. The solute may be any material adapted to uniformly disperse in the solvent at the appropriate level, (e.g., ionic level, molecular level, colloidal particle level or as a suspended solid). For example, a solution may be a uniformly dispersed mixture of ions, of molecules, of colloidal particles, or may even include mechanical suspensions.

The term "permeability" as used herein refers to the ability of a fluid, such as, for example, a gas to pass through a particular porous material. Permeability may be expressed in units of volume per unit time per unit area, for example, (cubic feet per minute) per square foot of material (e.g., ($ft^3$/minute/$ft^2$). The permeability was determined utilizing a Hagerty Technologies Model 1 Air Permeability Tester available from Hagerty Technologies, Inc. of Queensbury, N.Y. The Air Permeability Tester is set up so the pressure drop across the specimen was about 102 millimeters of water. Instrument readings were reported in units of (cubic centimeters per minute) per square centimeter of material, that is, (($cm^3$/minute)/$cm^2$). These instrument readings may also be expressed in CORESTA permeability units of centimeters per minute (cm/min). Permeability determinations for relatively small samples may be made utilizing a rectangular orifice (0.478cm×1 cm) having a cross-sectional area of about 0.478 $cm^2$. Instrument readings taken when the template was utilized are divided by 0.478 to obtain an approximate CORESTA permeability in units of cm/min.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The problems described above are addressed by the present invention which is a process of making a coated paper. The process includes the following steps: 1) providing a paper layer composed of a blend of pulp fibers and particulate material containing polyvalent metal cations, 2) applying a solution of a material selected from salts and/or derivatives of alginic acid to cover at least a portion of the paper, 3) reacting the salts and/or derivatives of alginic acid with polyvalent metal cations in the paper to form a polymer coating, and 4) drying the paper and polymer coating. Generally speaking, the permeability of the coated paper is at least about 75 percent less than the permeability of an identical uncoated portion of the paper. For example, the permeability of the coated paper may be at least about 80 percent less than the permeability of an identical uncoated portion of the paper.

The paper layer may be composed of a blend of from about 60 to about 90 percent, by weight, pulp fibers and from about 10 to about 40 percent, by weight, of a particulate that contains polyvalent metal cations (e.g., calcium and/or magnesium cations). For example, the paper layer may contain from about 10 to about 40 percent, by weight, calcium carbonate particles as a source of calcium cations. As a further example, the paper layer may be composed of a blend of about 70 percent, by weight, pulp fibers and about 30 percent, by weight, calcium carbonate particles.

According to the invention, salts and/or derivatives of alginic acid which may be used in the solution may be, for example, ammonium alginate, potassium alginate, sodium alginate or propylene glycol alginate and/or mixtures of the same. In one aspect of the invention the solution may be an acidified solution of a salt and/or derivative of alginic acid. For example, the acidified solution may have a pH of less than about four (4). Desirably, the acidified solution may have a pH of about three (3). According to the invention, the acidified solution may be an acidified solution of sodium alginate having a concentration of less than about four (4) percent, by weight. Desirably, the acidified solution of sodium alginate may have a concentration of from about one (1) to about three (3) percent, by weight. In another aspect of the invention, the acidified solution of sodium alginate may be partially cross-linked with an effective amount of polyvalent metal cations before being applied to the paper layer.

According to the invention, the solution may be applied to the paper by any suitable application technique. Desirably, the solution may be applied to the paper utilizing gravure-based printing techniques. Alternatively and/or additionally, the solution may be applied by spraying, spattering, dripping, press coating or similar techniques.

In another aspect of the process of the present invention, a solution containing polyvalent metal ions may be applied to the deposited alginate material after the alginate solution has been applied to the paper layer.

The present invention encompasses a coated paper composed of: 1) a paper layer made of a blend of pulp fibers and particulate material containing polyvalent metal cations; and 2) a polymer coating substantially covering at least a portion of the paper in which the polymer coating is a reaction product of polyvalent metal cations in the paper and a solution of a material selected from salts and/or derivatives of alginic acid. Generally speaking, the coated portion of the paper is at least about 75 percent less permeable than an identical uncoated portion of the paper. For example, the coated portion of the paper may be at least about 80 percent less permeable than an identical uncoated portion of the paper.

The paper layer may be composed of a blend of pulp fibers and calcium carbonate particles. For example, the paper layer may be composed of a blend of from about 60 to about 90 percent, by weight, pulp fibers and from about 10 to about 40 percent, by weight, calcium carbonate particles. As a further example, the paper layer may be composed of a blend of about 70 percent, by weight, pulp fibers and about 30 percent, by weight, calcium carbonate particles.

According to the invention, the solution of a material selected from salts and/or derivatives of alginic acid may be acidified and/or partially cross-linked (i.e., reacted with an effective amount of polyvalent metal cations).

The present invention also encompasses a wrapper for a smoking article. The wrapper is composed of a coated paper which includes: 1) a paper layer made of a blend of pulp fibers and particulate material containing polyvalent metal cations; and 2) a polymer coating substantially covering at least a portion of the paper in which the polymer coating is a reaction product of polyvalent metal cations in the paper and a solution of a material selected from salts and/or derivatives of alginic acid. Generally speaking, the coated portion of the paper has a CORESTA permeability of less than about 10 cm/min. For example, the coated portion of the paper may have a CORESTA permeability of less than about eight (8) cm/min. As a further example, the coated portion of the paper may have a CORESTA permeability of less than about six (6) cm/min.

The present invention encompasses yet another process of making a coated paper. This process includes the following steps: 1) providing a paper layer; 2) applying a solution of a material selected from salts and derivatives of alginic acid to at least a portion of the paper; 3) applying a solution of a material including polyvalent metal cations to at least a portion of paper with the applied solution of salts and derivatives of alginic acid; 4) reacting the salts and/or derivatives of alginic acid with polyvalent metal cations to form a polymer coating; and 5) drying the paper and polymer coating. The present invention encompasses a coated paper and a wrapper for a smoking article manufactured by the process described above.

DETAILED DESCRIPTION OF THE INVENTION

Figure 1:
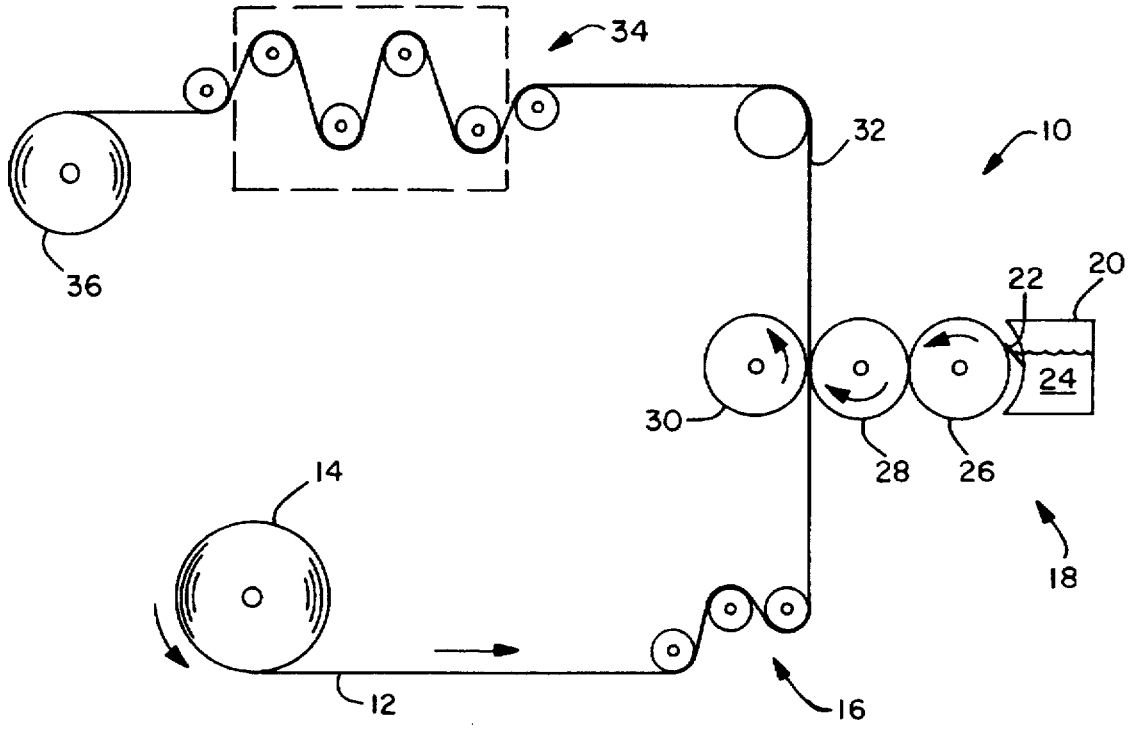
FIG. 1 is an illustration of an exemplary process for making a coated paper.

Referring to the drawing and in particular to FIG. 1, there is shown at 10 an exemplary process of the present invention for making a coated paper.

According to the present invention, a paper layer 12 is unwound from a supply roll 14 and travels in the direction indicated by the arrow associated therewith as the supply roll 14 rotates in the direction of the arrows associated therewith. The paper layer 12 may be formed by one or more paper-making processes and passed directly into the process 10 without first being stored on a supply roll 14.

Generally speaking, the paper layer 12 is composed of a blend of pulp fibers and particulate material containing polyvalent metal cations. The paper layer may be composed of a blend of from about 60 to about 90 percent, by weight, pulp fibers and from about 10 to about 40 percent, by weight, calcium carbonate particles. For example, the paper layer may be composed of a blend of about 70 percent, by weight, pulp fibers and about 30 percent, by weight, calcium carbonate particles. As a further example, the paper layer may be a conventional cigarette paper made of wood and/or flax pulp and a metal salt filler (i.e., calcium carbonate).

The paper layer 12 may be passed through a pre-treatment station (not shown) to modify the surface of the paper. For example, the paper layer may be calendered or pressed in order to achieve desired physical and/or textural characteristics. Additionally, at least a portion of the surface of the paper may be modified by various known surface modification techniques prior to applying the alginate solution.

Exemplary surface modification techniques include, for example, chemical etching, chemical oxidation, ion bombardment, plasma treatments, flame treatments, heat treatments, and/or corona discharge treatments. Generally speaking, the paper layer may have a moisture content of about five (5) percent, by weight.

The paper layer 12 passes through the nip of an S-roll arrangement 16 in a reverse-S path. From the S-roll arrangement 16, the paper layer 12 passes to a gravure printing arrangement 18. The gravure printing process may be a direct print process or an indirect print process. FIG. 1 depicts an indirect print process. A direct print process may be desirable where large amounts of material (e.g., solution) are to be applied to the paper layer.

The gravure printing arrangement contains a solution tank 20 and a doctor blade 22 which is used to apply a solution 24 to a gravure roll 26. The solution 24 contains salts and/or derivatives of alginic acid. The solution may contain ammonium alginate, potassium alginate, sodium alginate or propylene glycol alginate and/or mixtures of the same. Desirably, the solution contains sodium alginate. Suitable salts and/or derivatives of alginic alginic acid may be obtained from KELCO division of Merck & Co., Inc., which is located in San Diego, Calif. Exemplary products include KELGIN MV, a granular refined sodium alginate having a mesh size of about 30. A one (1) percent solution of KELGIN MV has a viscosity of about 400 centipoise at 25° C. as measured using a Brookfield LVF Viscometer. A two (2) percent solution of KELGIN MV has a viscosity of about 6000 centipoise at 25° C. as measured using a Brookfield LVF Viscometer.

The solution 24 may be an acidified solution of a salt and/or derivative of alginic acid. Generally speaking, the acidified solution may have a pH of less than about four (4). Desirably, the acidified solution may have a pH between about three (3) and four (4). The solution may be acidified with an appropriate amount of an organic or inorganic acid. Generally speaking, inorganic acids such as, for example, hydrochloric acid and phosphoric acid have been found to work well.

Although the inventors should not be held to any particular theory of operation, it is believed that when an acidified solution is deposited on the paper layer incorporating particulate material containing polyvalent metal cations (e.g., calcium and/or magnesium cations), the acidified solution may dissolve some of the particulate materials and may free up more polyvalent metal cations in the paper layer for reaction with the salts and/or derivatives of alginic acid in the solution. For example, calcium carbonate filler present in the paper layer of some embodiments of the present invention begins to dissolve at a pH of six (6). The reaction product of polyvalent metal cations and the salts and/or derivatives of alginic acid may vary depending on the concentration and type of polyvalent metal cation and/or alginate material. According to the present invention, it is desirable that the reaction product form a generally insoluble polymer.

It is desirable for the solution to contain a relatively low level of suspended solids. Generally speaking, the ability of such a solution to form a suitable polymer coating on the paper layer (e.g., wherein the permeability of the coated paper is at least about 75 percent less than the permeability of an identical uncoated portion of the paper) indicates efficient and economical application of the salts and/or derivatives of alginic acid. According to the present invention, an acidified solution of sodium alginate having a concentration of less than about four (4) percent, by weight, may form a suitable polymer coating on the paper layer. Desirably, an acidified solution of sodium alginate having a concentration of from about one (1) to about three (3) percent, by weight, should be able to form a suitable polymer coating on the paper layer. In addition to freeing up more polyvalent metal cations in the paper layer for reaction, acidification of the alginate solution increases its viscosity allowing lower concentrations of alginate solids to be used to provide the appropriate viscosity for gravure printing.

The gravure roll 26 may be engraved with a conventional continuous cell pattern (e.g., quadrangular cell pattern) arranged in parallel bands across the width of the roll with nonengraved areas between each band. For example, one cell pattern which may be used is conventionally specified as about 60 lines, 140 depth, about 10/15 wall and about 48.7 CBM. It is contemplated that other conventional patterns such as, for example, grooves and/or notch patterns may be used. Each gravure cell holds a small amount of the solution which is released in a pattern onto a rubber applicator roll 28. The paper layer 12 passes through a nip between the rubber applicator roll 28 and a cooperating backup roll 30. The solution is transferred from the applicator roll 28 to the surface of the paper layer 12 thereby forming a coated paper 32. The speeds of the gravure roll 26 and the applicator roll 30 may be controlled so they are the same or so they differ by a minor amount to influence the application of the solution.

Generally speaking, relatively high solution concentrations may affect the rheology of the solution making gravure printing of the solution onto the paper layer quite difficult or impractical. It is believed that an embodiment of the process of the present invention which employs an acidified solution of a salt and/or derivative of alginic acid containing low levels of solids is both economically and operationally desirable.

In another aspect of the invention, the acidified solution of a salt and/or derivative of alginic acid may be partially cross-linked with an effective amount of polyvalent metal cations. Such partial cross-linking may be desirable when relatively low levels of solids are present in the solution.

A material containing polyvalent metal cations may be added in an amount such that the level of polyvalent metal cations may be up to about 10 percent of the weight of the alginate solids in the solution. For example, the concentration of polyvalent metal cations may be from about one (1) to about eight (8) percent of the weight of alginate solids in the solution. Desirably, the concentration of polyvalent metal cations may be from about two (2) to about seven (7) percent of the weight of alginate solids in the solution. Such partial cross-linking tends to affect the rheology of the solution. Partially cross-linked alginate may form a thixotropic gel which, in some situations, can survive the shear stress associated with gravure printing. That is, the partially cross-linked gel may become liquified upon application of shear stresses during the gravure printing operation. Once on the paper surface, the partially cross-linked alginate gel resets to form a polymer coating. This phenomena is desirable because at higher polyvalent metal cation concentrations, many reacted alginate systems (e.g., calcium reacted alginate systems) produce gels which will irreversibly break down when subject to mechanical disruption.

In general, useful materials containing polyvalent metal cations (e.g., calcium and/or magnesium cations) which may be used for partial cross-linking include, for example, calcium chloride, calcium lactate, calcium gluconate and the like.

According to the invention, a solution containing from about one (1) to about four (4) percent, by weight, alginate solids is applied to the paper layer utilizing gravure printing techniques at a rate greater than about 0.2 grams per square meter of the paper layer. For example, the solution may be applied at a rate of from about 0.4 to about 0.8 grams per square meter. The solution may be applied to the paper layer in a continuous or discontinuous manner. For example, the solution may be applied to form bands, ribbons or streaks on the paper layer. Within the bands, ribbons or streaks, the solution may be applied in a continuous or discontinuous manner. An exemplary print pattern contains three (3) to eight (8) millimeter wide bands of solution separated by eight (8) to 25 millimeters of uncoated (i.e., solution-free) paper. As another example, a print pattern may contain five (5) to seven (7) millimeter wide bands of solution separated by 10 to 20 millimeters of uncoated paper. In many situations, the solution is applied to the wire side of the paper layer.

According to one aspect of the invention, a solution having a very low level of alginate solids (e.g., from about 0.2 to about 0.8 percent, by weight) may be applied at a relatively high rate (e.g., from about 1 to about 2.5 grams per square meter) to completely cover one side of the paper layer. A solution containing polyvalent metal ions may then be applied to the coated paper to promote formation of an insoluble polymer coating. For example, a solution containing from about 0.2 to about 0.8 percent, by weight, alginate solids may be applied at a rate of about one (1) to about 2.5 grams per square meter. A solution having a calcium level of about 0.2 to about 0.6 percent of the weight of alginate solids may then be applied to at least a portion of the coated paper to promote formation of an insoluble polymer coating. As a further example, a solution containing about 0.6 percent, by weight, alginate solids may be applied at a rate of about 1.6 grams per square meter. A solution having a calcium level of about 0.4 percent of the weight of alginate solids may then be applied to at least a portion of the coated paper to promote formation of a polymer coating.

The coated paper 32 is then passed through a drying operation 34 before being wound onto a storage roll 36. The drying operation may operate at ambient temperature or include the use of heat to ensure a dry material is wound onto the storage roll 36. In addition to accomplishing the necessary drying of the coated paper, removing water and/or applying heat may accelerate the reaction between the polyvalent metal cations in the paper and the salts and/or derivatives of alginic acid. Exemplary drying operations include processes which incorporate infra-red radiation, yankee dryers, steam cans, microwaves, hot-air and/or through-air drying techniques, and ultrasonic energy.

The present invention also encompasses a coated paper which may be produced by the process described above. The coated paper is composed of: 1) a paper layer made of a blend of pulp fibers and particulate material containing polyvalent metal cations; and 2) a polymer coating substantially covering at least a portion of the paper in which the polymer coating is a reaction product of polyvalent metal cations in the paper and a solution of a material selected from salts and/or derivatives of alginic acid. Generally speaking, the coated portion of the paper is at least about 75 percent less permeable than an identical uncoated portion of the paper. For example, the coated portion of the paper may be at least about 80 percent less permeable than an identical uncoated portion of the paper. Coated papers having reduced levels of permeability have many applications in fields such as the manufacture of smoking articles, packaging materials (e.g., food packaging materials), printing papers and reprographic papers, and the like.

The present invention also encompasses a wrapper for a smoking article. The wrapper is composed of a coated paper which includes: 1) a paper layer made of a blend of pulp fibers and particulate material containing polyvalent metal cations; and 2) a polymer coating substantially covering at least a portion of the paper in which the polymer coating is a reaction product of polyvalent metal cations in the paper and a solution of a material selected from salts and/or derivatives of alginic acid. The polymer coating may be distributed in bands across the paper. Generally speaking, the coated portion of the paper has a CORESTA permeability of less than about 10 cm/min. For example, the coated portion of the paper may have a CORESTA permeability of less than about eight (8) cm/min. As a further example, the coated portion of the paper may have a CORESTA permeability of less than about six (6) cm/min.

EXAMPLES

Examples were prepared generally in accordance with the process described above. A cigarette paper (Kimberly-Clark Grade 666 or Grade 603) containing about 70 percent by weight pulp and about 30 percent by weight calcium carbonate filler was unwound from a supply roll. The paper entered a conventional direct gravure printing operation composed of a metal gravure roll and a rubber impression roll.

The metal gravure roll was engraved in bands extending across the width of the roll. The band width was about 6.5 millimeters and the unengraved spacing between bands was about 13.5 millimeters. The engraving within the bands consisted of a conventional quadrangular cell pattern: 60 line, 140 micron depth, 10–15 micron wall thickness, 48 CBM. The gravure pattern was designed to deposit an alginate solution onto the paper at 25–35 grams per square meter fluid add-on in the bands.

Alginate solution was applied directly to the paper from the gravure roll. The alginate solution contained about three (3) percent, by weight, of a refined sodium alginate available from KELCO division of Merck & Co., Inc. under the trade designation KELGIN LV. The paper (i.e., calcium carbonate) and alginate solution reacted to form a polymer coating. The coated paper then passed to a steam can arrangement to dry the paper and polymer coating.

The dry weight of the polymer coating (i.e., dry solids of the calcium reacted alginate polymer system) in the printed areas was calculated from the concentration of the alginate in the solution and the amount of alginate solution applied to a particular area. The calculated dry weight of the coating is reported in Table I (Sample #1) as 0.87 grams per square meter under the heading "Dry Solids".

The permeability of the paper in both the coated and uncoated portions was determined utilizing a Hagerty Technologies Model 1 Air Permeability Tester according to the procedures described above. The permeability in the printed band was 6.2 cm per minute (CORESTA units). This represented an 82 percent reduction in the base paper permeability which is reported under the heading "Permeability—W/O Band".

In a further example (Table I, Sample #2), a three (3) percent solution of sodium alginate was acidified with hydrochloric acid to a pH of about four (4). The permeability of the paper in the printed band was 5.2 cm per minute, which was an 84 percent reduction in the base paper permeability.

Comparative examples were prepared generally in accordance with the process described above. One example (Table I, Sample #3), utilized a three (3) percent solution of sodium carboxymethylcellulose (CMC) available from Aqualon Corporation under the trade designation Aqualon CMC-7M. This coating was significantly less effective in reducing the permeability of the paper in the coated areas. The coated paper permeability was 18.4 cm per minute, representing a reduction of 55 percent in the base paper permeability.

A further example (Table I, Sample #4) was prepared using a six (6) percent solution of polyvinyl alcohol (PVOH) available from DuPont under the trade designation Elvanol Type 71–30. Although significantly higher coating solids were used, a permeability reduction of only 48 percent was achieved, resulting in a coated permeability of 20.8 cm per minute.

In an additional set of examples (Table II), samples were prepared generally in accordance with the process described above except that the engraving within the bands consisted of a conventional quadrangular cell pattern: 60 line, 123 micron depth, 20 micron wall thickness. The alginate solution contained refined sodium alginate available from KELCO Division of Merck & Co., Inc. under the trade designation KELGIN-MV. At similar solution concentrations, this grade has a significantly higher viscosity than the alginate grade KELGIN-LV used in the previous trials. As a result of the higher viscosity and modified gravure cell pattern, fluid pickups for this set of examples were significantly reduced from those reported above and consequently, the dry solids add-on of the alginate coating is also reduced.

Referring to Table II, Samples 1–3 show the effect of the concentration of alginate (KELGIN-MV) in the solution. Generally, increasing the solution concentration of alginate results in a higher coating solids transfer to the paper and a resulting reduction in permeability of the coated paper. This effect is counterbalanced however, by increases in the solution viscosity at higher concentrations, which tends to decrease fluid transfer to the paper. This is particularly evident in comparing Samples 2 and 3, where only marginal increases in dry solids add-on and decreases in permeability are noted as the solution concentration is increased from two (2) to three (3) percent.

In a further example (Table II, Sample 4), a one (1) percent solution of KELGIN-MV was acidified with an organic acid to a pH of about three (3). This resulted in a significantly lower coated paper permeability without an increase in coating solids.

In an additional example, the one (1) percent solution of KELGIN-MV was partially cross-linked (or partially reacted) with a solution of calcium lactate. The calcium lactate solution was prepared so that the stoichiometric level of calcium was about 10 percent of the weight of the alginate material in the alginate solution. The partially cross-linked alginate solution was prepared under high shear stresses to form a solution which included precipitated alginate polymer. This partially cross-linked (reacted) solution was then applied to the paper surface generally in accordance with the process described above (i.e. utilizing the gravure printing techniques described above). Paper coated in this manner had a significantly lower permeability without an increase in the amount of applied coating solids (over Sample 1, Table II).

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

TABLE I

| Sample | Paper Grade | Treatment | Wet Pickup g/m² | Dry Solids g/m² | Permeability cm/min W/O Band | Permeability cm/min Band | Reduction-% |
|---|---|---|---|---|---|---|---|
| #1 | 666 | ALGINATE-3% KELGIN LV | 29 | 0.87 | 33.8 | 6.2 | 82 |
| #2 | 666 | ALGINATE-3% KELGIN LV-pH4 | 32 | 0.96 | 31.8 | 5.2 | 84 |
| #3 | 603 | CMC-3% | 25 | 0.75 | 41.2 | 18.4 | 55 |
| #4 | 603 | PVOH-6% | 32 | 1.92 | 39.4 | 20.8 | 48 |

TABLE II

| Sample | Paper Grade | Treatment | Dry Solids g/m² | Permeability cm/min Band |
|---|---|---|---|---|
| #1 | 603 | KELGIN MV-1% | 0.30 | 23.3 |
| #2 | 603 | KELGIN MV-2% | 0.56 | 12.0 |
| #3 | 603 | KELGIN MV-3% | 0.58 | 10.7 |
| #4 | 603 | KELGIN MV-1% pH-3 | 0.27 | 14.5 |
| #5 | 603 | KELGIN MV-1% pH-3; added Ca | 0.32 | 5.3 |

What is claimed is:

1. A process for reducing the permeability of a paper used in the construction of a smoking article, said process comprising the following steps:

providing a paper layer comprised of a blend of pulp fibers and particulate material containing polyvalent metal cations, wherein said particulate material comprises calcium carbonate and said polyvalent metal cations comprise calcium;

applying an acidic alginate solution containing a material selected from salts and derivatives of alginic acid to cover at least a portion of the paper, said alginate solution having a pH of 3 or less;

reacting said material selected from salts and derivatives of alginic acid with said polyvalent metal cations contained in said paper layer to form a polymer coating; and drying the paper and polymer coating.

2. The process of claim 1, wherein the permeability of the coated paper is at least about 75 percent less than the permeability of an identical uncoated portion of the paper.

3. The process of claim 1, wherein said alginate solution is a solution of a material selected from ammonium alginate, potassium alginate, sodium alginate and propylene glycol alginate.

4. The process of claim 1, wherein said alginate solution is an acidified solution of sodium alginate having a concentration of from about 1 to about 3 percent, by weight.

5. The process of claim 1, wherein the alginate solution is applied utilizing gravure printing techniques.

6. The process of claim 1, wherein a solution containing polyvalent metal ions is applied to the alginate solution after the alginate solution is applied to the paper layer.

7. A process as defined in claim 1, wherein said alginate solution contains less than 4 percent by weight alginate solids.

8. A process as defined in claim 1, wherein said acidic alginate solution has a pH of about 3.

9. A process as defined in claim 1, wherein said paper layer is comprised of from about 10 percent to about 40 percent by weight calcium carbonate particles.

10. A process as defined in claim 1, wherein said acidified alginate solution is partially cross-linked with polyvalent metal cations, said polyvalent metal cations being present in an amount of up to about 10 percent by weight based on the weight of alginate solids in the solution.

11. A process for reducing the premeability of a paper used in the construction of a smoking article comprising the following steps:

providing a paper layer comprised of a blend of pulp fibers and a particulate material containing polyvalent metal cations, wherein said particulate material comprises calcium carbonate and said polyvalent metal cations comprise calcium;

applying an acidic alginate solution containing a material selected from salts and derivatives of alginic acid to cover at least a portion of the paper, said alginate solution being partially cross-linked with polyvalent metal cations and having a pH of 3 or less;

reacting said material selected from salts and derivatives of alginic acid with polyvalent metal cations in the paper to form a polymer coating; and drying the paper and polymer coating.

12. A process as defined in claim 11, wherein said polyvalent metal cations used to partially cross-link said partially cross-linked alginate solution are added in an amount up to about 10 percent by weight based on the weight of alginic solids in said alginate solution.

13. A process as defined in claim 11, wherein said alginate solution is partially cross-linked by adding a material selected from the group consisting of calcium chloride, calcium lactate, and calcium gluconate to said solution.

14. A coated paper used in the construction of a smoking article, said coated paper being made by the process of claim 1, or claim 11.

* * * * *